US005758949A

United States Patent [19]

Van Deursen

[11] Patent Number: 5,758,949

[45] Date of Patent: Jun. 2, 1998

[54] COLLAPSIBLE LANTERN

[75] Inventor: Gary Van Deursen, Evergreen, Colo.

[73] Assignee: The Coleman Company, Inc., Wichita, Kans.

[21] Appl. No.: 806,925

[22] Filed: Feb. 26, 1997

[51] Int. Cl.[6] ..... F21L 3/00

[52] U.S. Cl. ..... 362/186; 362/162; 362/285; 362/202

[58] Field of Search ..... 362/162, 186, 362/102, 202, 205, 197, 223, 260, 319, 285, 277, 217

[56] References Cited

U.S. PATENT DOCUMENTS

| | | | |
|---|---|---|---|
| D. 293,482 | 12/1987 | Geissler . | |
| D. 317,057 | 5/1991 | Argandona . | |
| D. 321,568 | 11/1991 | Yuen . | |
| D. 363,563 | 10/1995 | Yuen . | |
| 2,530,069 | 11/1950 | Moore . | |
| 4,186,430 | 1/1980 | Britton | 362/162 |
| 4,520,431 | 5/1985 | Fanelli | 362/180 |
| 4,566,055 | 1/1986 | Klees | 362/162 |
| 4,646,213 | 2/1987 | Fanelli | 362/180 |
| 4,926,297 | 5/1990 | Masters | 362/162 |
| 5,016,148 | 5/1991 | Kohm | 362/102 |
| 5,343,825 | 9/1994 | Gazecimeon et al. | 362/102 |
| 5,424,928 | 6/1995 | Jordan | 362/162 |
| 5,642,931 | 7/1997 | Gappelberg | 362/186 |

OTHER PUBLICATIONS

Coleman catalog page for Companion Lantern, Jul. 1995.

*Primary Examiner*—Thomas M. Sember

[57] ABSTRACT

A collapsible lantern includes a base, a light source, a globe surrounding the light source, and a cap above the globe and the light source. The globe and light source are telescopingly mounted for movement between a lowered position in which the cap is adjacent the base and a raised position in which the cap is spaced above the base and the globe and light source extend between the base and the cap.

16 Claims, 6 Drawing Sheets

COLLAPSIBLE LANTERN

BACKGROUND

This invention relates to collapsible lanterns, and, more particularly, to an electrically powered collapsible lantern in which a light source remains electrically connected to a power source as the light source moves between collapsed and extended positions.

Collapsible lanterns which have been provided in the past generally include a candle or wick which provides a flame as a light source. The candle or wick is mounted in a base, and a transparent glove is telescopingly mounted in the base. Although the globe telescopes or collapses into a storage position, the candle or wick does not. Examples of such candle lanterns are described in U.S. Pat. Nos. 5,424,928, 4,926,297, 4,646,213, 4,566,055, 4,520,431, and 4,186,430.

The Coleman Company, Inc. has sold a collapsible lantern under the name Companion Lantern. A globe is telescopingly mounted in a base, and a cap is mounted on top of the globe. A light bulb is mounted in the globe and is connected to batteries which are mounted in the cap. The relative positions of the bulb and the batteries remain fixed as the globe, bulb, and cap telescope relative to the base.

SUMMARY OF THE INVENTION

The invention provides a collapsible lantern in which a power source is mounted in the base. A light source and a globe are telescopingly mounted relative to the base, and a cap is mounted on top of the globe. A pair of metal rods are telescopingly mounted in the base and extend through the globe to the cap. The rods are electrically connected to the power source and to the light source so that the light source remains electrically connected to the power source as the light source and the globe telescope relative to the base.

DESCRIPTION OF THE DRAWING

The invention will be explained in conjunction with an illustrative embodiment showing the accompanying drawings, in which.

DESCRIPTION OF SPECIFIC EMBODIMENT

Figure 1:
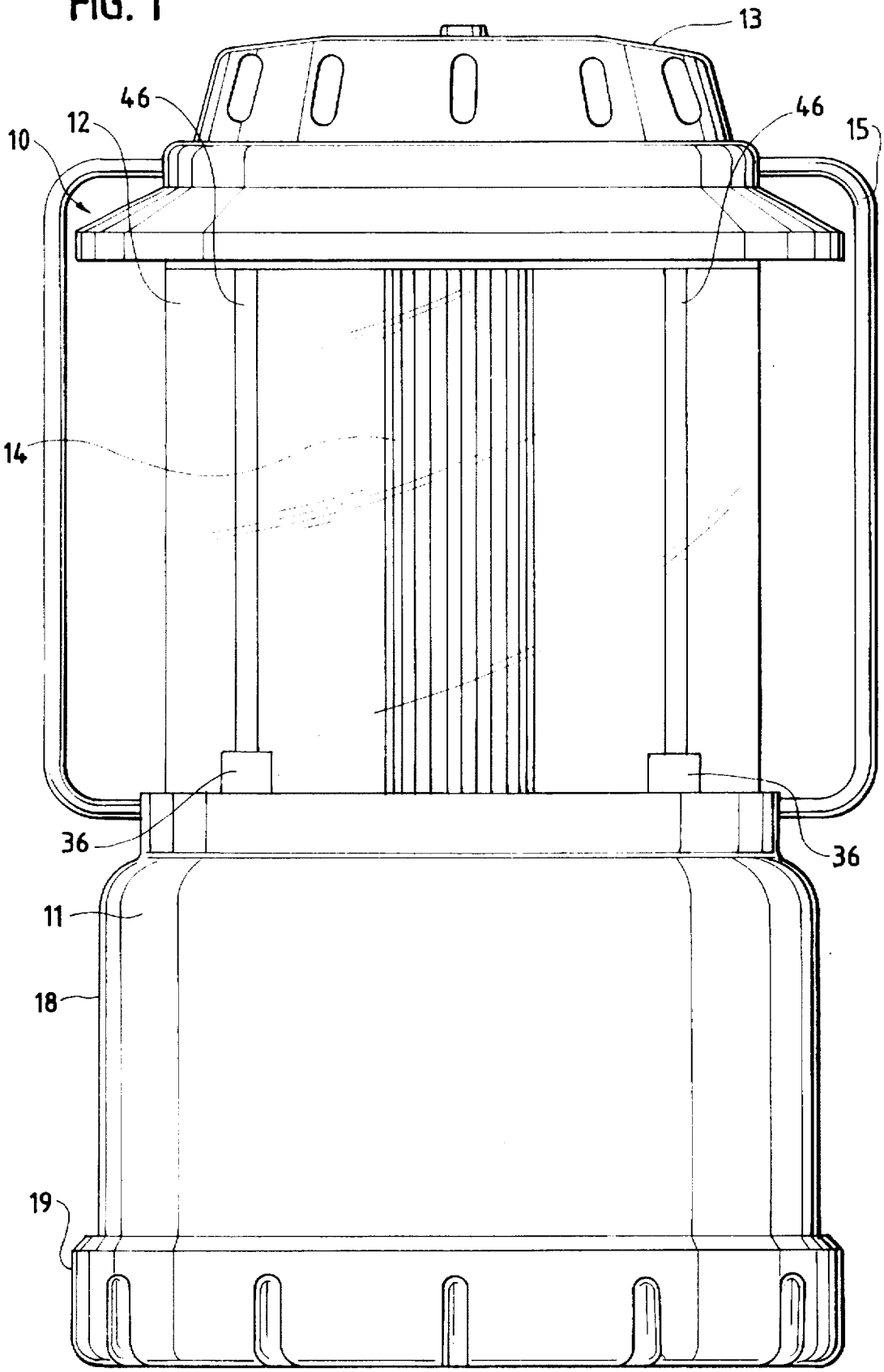
FIG. 1 is an elevational view of a collapsible lantern which is formed in accordance with the invention.

The numeral 10 designates generally a collapsible lantern which includes a base 11, a transparent globe 12, a cap 13, and a light source 14 inside of the globe. A bail 15 is pivotally attached to the cap for carrying the lantern. The appearance of the lantern simulates the appearance of the well known Coleman™ liquid fuel lanterns.

The base 11 can be molded from plastic and includes a generally cylindrical side wall 18, a bottom cap 19 (FIG. 4), and an access door 20 which is threadedly engaged with an internally thread opening 21 in the bottom cap. The bottom cap includes an upstanding cylindrical flange 23 which is threadedly engaged with the side wall 18, a bottom wall 24 which is substantially flush with the access door 20, a upwardly extending step 25, and a radially extending annular wall 26.

Four arcuate walls 29 (FIGS. 3 and 4) extend upwardly from the annular wall 26 and provide a generally cylindrical inside wall which has an outside diameter slightly less than the inside diameter of the globe 12. A partition 30 extends radially inwardly from the center of each of the arcuate walls 29.

A top wall 34 of the base is supported by the arcuate walls 29 and partitions 30. The top wall 34 includes a circular outer periphery 35 which is spaced from the side wall 18 of the base to permit the globe 12 to slide between the top wall and the side wall. The top wall includes a pair of upwardly extending cylindrical bosses 36 and a central cylindrical flange 37 which defines an opening 38. A mirror or reflector 39 is supported by the top wall.

Figure 3:
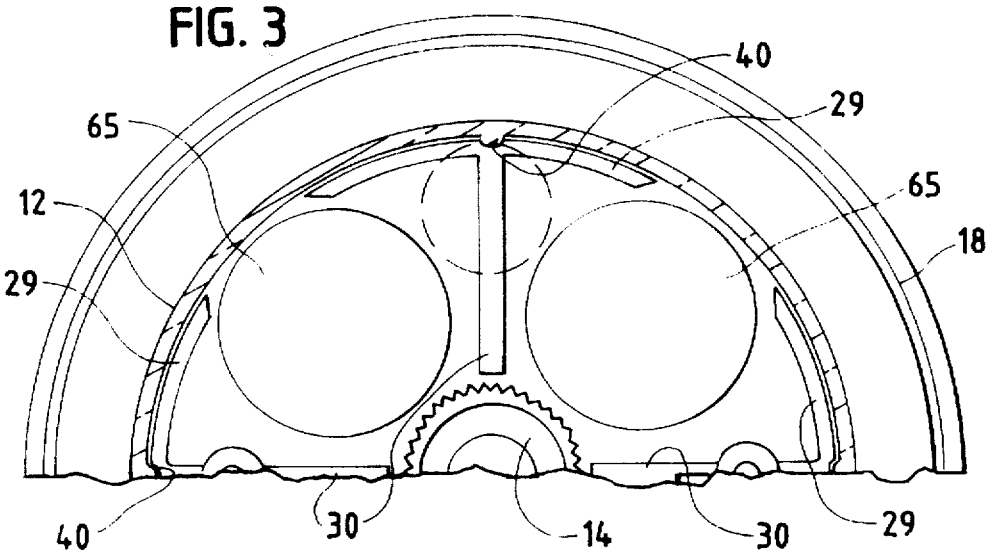
FIG. 3 is a sectional view taken along the line 3—3 of FIG. 2.

Referring to FIG. 3, the inside surface of the globe 12 includes four axially extending ribs 40 which extend into grooves in the arcuate walls 29. The ribs prevent the globe from rotating relative to the base.

Figure 2:
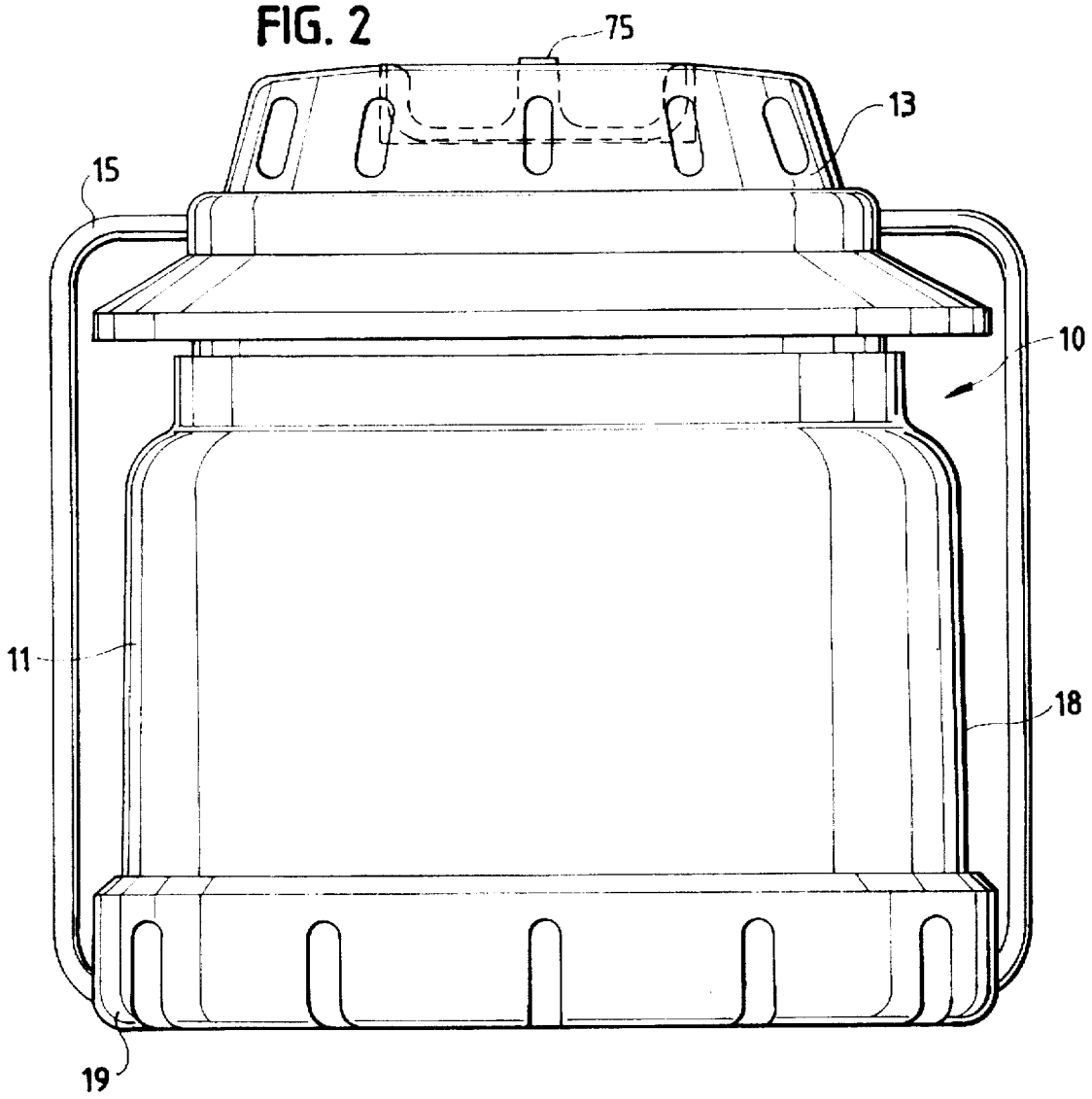
FIG. 2 is an elevational view showing the lantern in its collapsed position.
Figure 4:
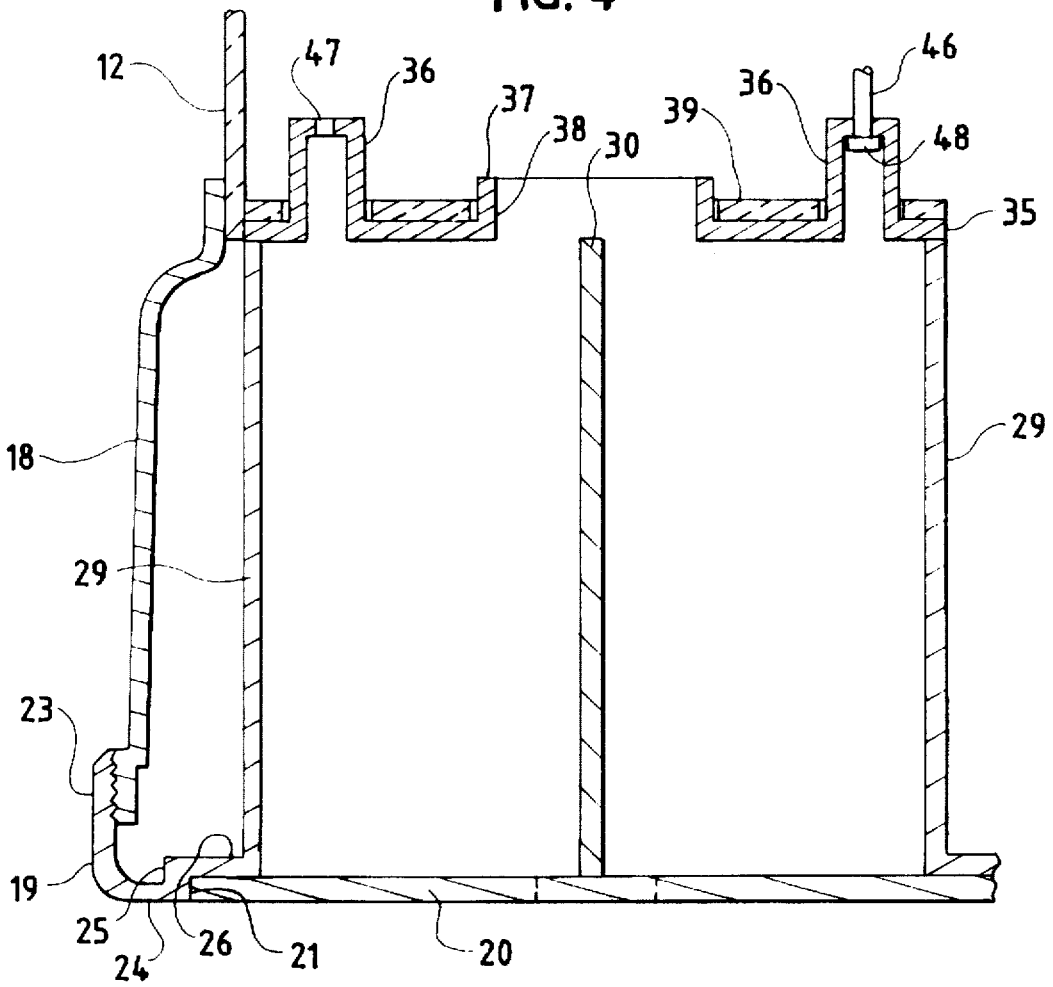
FIG. 4 is a fragmentary sectional view of the collapsible lantern shown in FIG. 1.
Figure 5:
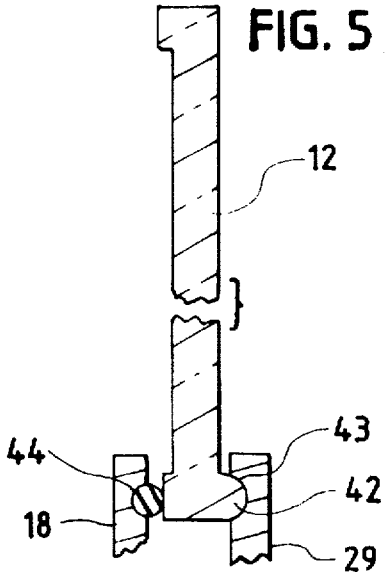
FIG. 5 is an enlarged fragmentary sectional view of a portion of FIG. 4.

Referring to FIG. 5, the bottom end of the globe includes a radially inwardly extending lip or bead 42 which is positioned in a recess 43 in the top end of each of the arcuate walls 29 when the globe is in its raised position illustrated in FIGS. 1 and 4. An elastic and resilient 0-ring 44 which is captured in a groove in the side wall of the base resiliently biases -the lip 42 into the recess 43 and releasably maintains the globe in the raised position. The lower ends of the arcuate walls 29 are provided with a similar recess for receiving the lip 42 and retaining the globe in its lowered position illustrated in FIG. 2.

A pair of metal rods 46 (FIGS. 1 and 4) are slidably received in openings 47 (FIG. 4) in the cylindrical bosses 36 of the top wall 34 of the base. The lower end of each rod includes a radially enlarged shoulder 48 which limits upward movement: of the rods and the globe when the globe reaches its raised position.

The cap 13 includes a bottom wall 51 (FIG. 1) and a top wall 52. The upper end portion of each rod 46 includes a radial enlarged flange 53 which is positioned in a cylindrical boss 54 in the bottom wall 51. The upper end of the rod extends through the boss, and a nut 55 is threaded onto the end of the rod so that the cap and rods move together.

The light 14 in the embodiment illustrated is a fluorescent tube which is slidably mounted in the opening 38 in the top wall of the base. The upper end of the fluorescent tube extends through an opening in the bottom wall of the cap, and the fluorescent tube moves up and down with the globe 12, cap 13, and rods 46. The ends of the fluorescent tube are plugged into standard fluorescent tube sockets. Standard exciter electronics are mounted within the cap 13.

Alternatively, the light source 14 can include an incandescent bulb which is mounted within an elongated tube similar to the fluorescent tube.

The light 14 is powered by a power source which is mounted within the base. In the embodiment illustrated the power source comprises four D size dry cell batteries 65 (FIG. 3). Each battery is mounted between a pair of partitions 30, and the batteries and partitions provide a space into which the elongated light 14 can telescope as the globe and light are moved to their lowered positions. The batteries can be changed by unscrewing the battery access door 30 (FIG. 4) from the base.

The power source is electrically connected to the light by the rods 46. One of the rods is electrically connected to the positive terminals of the batteries, and the other rod is electrically connected to the negative terminals of the batteries. The rods can be electrically connected to the batteries by metal spring contacts which engage the lower portions of the rods as the rods telescope. The upper ends of the rods are electrically connected to the positive and negative terminals of the light.

Figure 6:
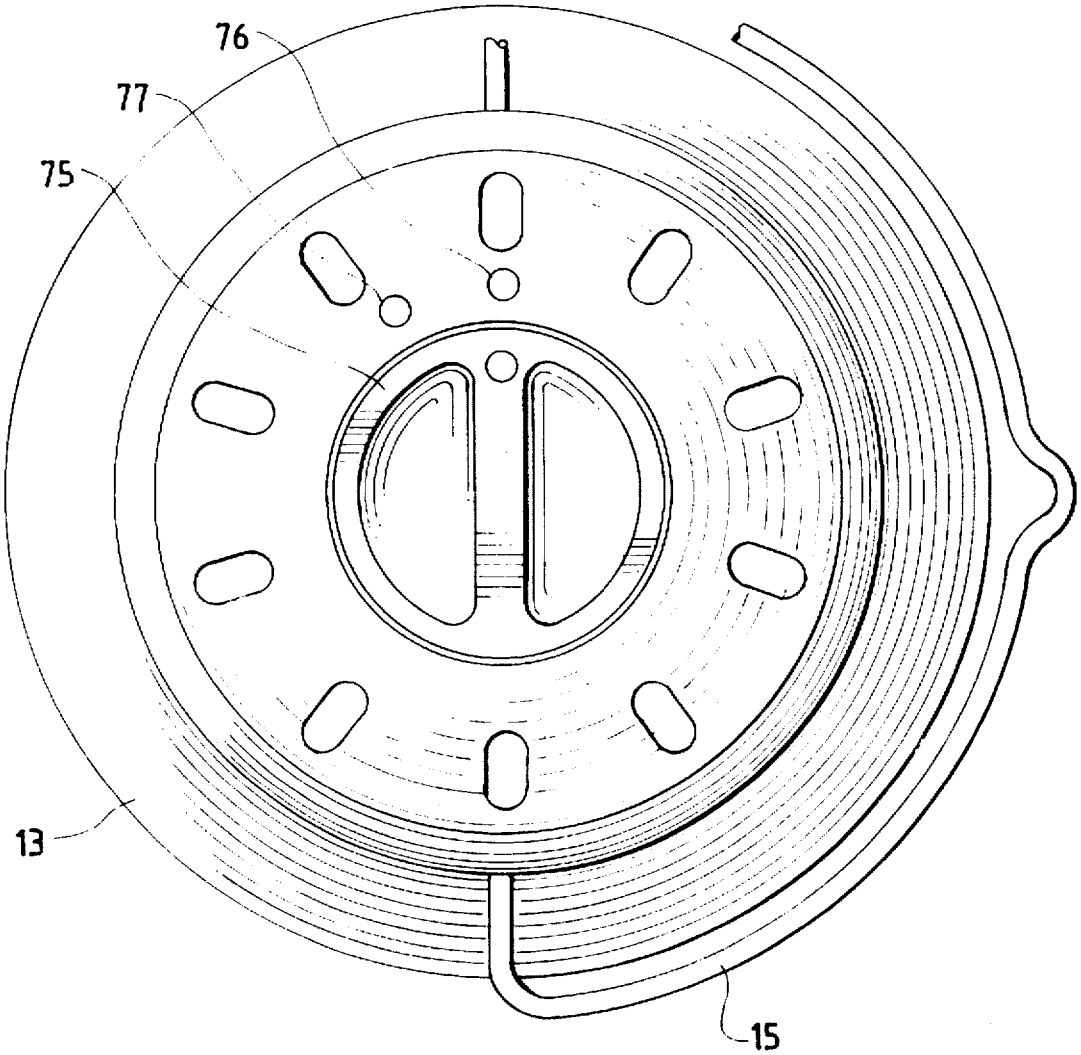
FIG. 6 is a top plan view of the lantern.

The light is controlled by a knob 75 (FIG. 6) in the top of the cap. The knob can rotate between an off position indicated by the circle 76 and an on position indicated by the dot 77.

When the globe 12, cap 13, and light 14 are in their raised positions illustrated in FIG. 1, light from the light source shines through the globe. When the lantern is not being used, the lantern can be stored in the compact, collapsed configuration illustrated in FIG. 2 by telescoping the globe, light, and rods 46 into the base. The cap 13 is positioned adjacent the top end of the base 11. The metal rods 46 telescope with the light, and the telescoping movement does not interfere with the electrical connection between the power source and the light.

Figure 7:
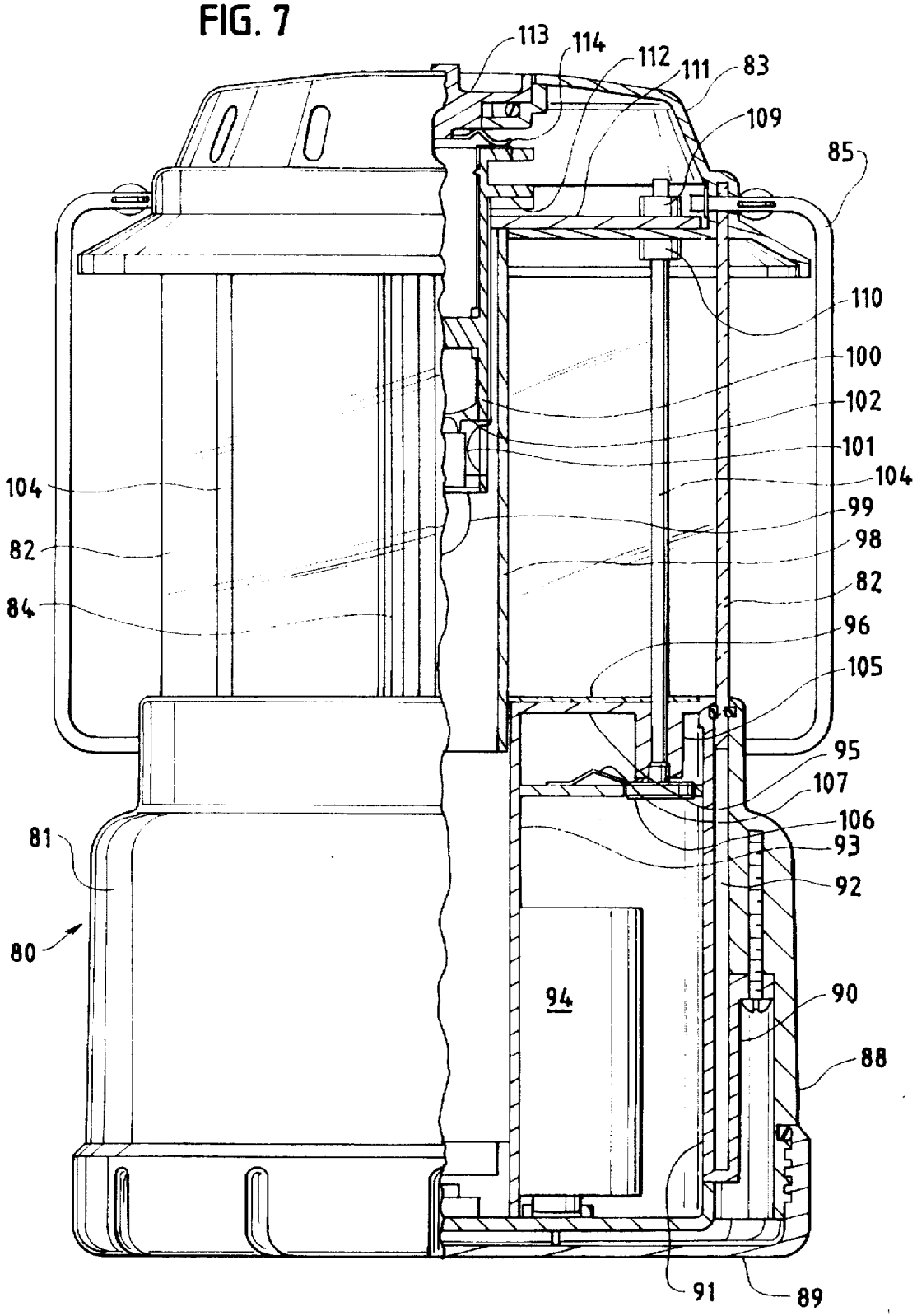
FIG. 7 is an elevational view, partially in section, of another embodiment of a collapsible lantern which is formed in accordance with the invention.
Figure 8:
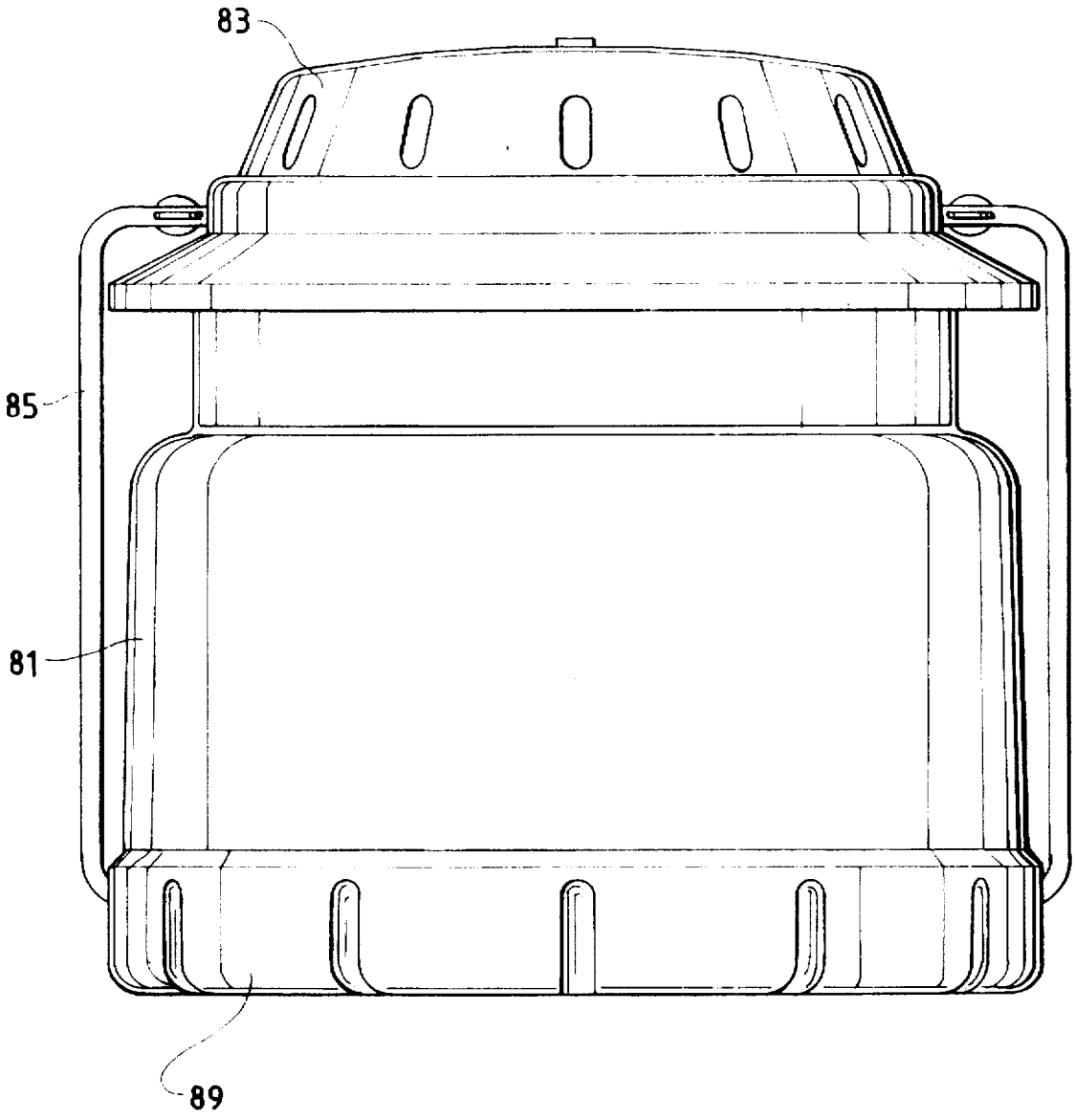
FIG. 8 is an elevational view showing the lantern of FIG. 7 in its collapsed position.

Referring to FIGS. 7 and 8, another embodiment of a collapsible lantern 80 includes a base 81, a transparent globe 82, a cap 83, and a light source 84 inside of the globe. The upper end of the globe extends into an annular channel formed by the cap 83, and the inwardly extending ends of a U-shaped bail 85 extend through the cap and the upper end of the globe to connect the globe to the lantern.

The base 81 includes a generally cylindrical outer side wall 88 and a bottom cap 89 which is threadedly engaged with the outer side wall. The base includes a pair of concentric cylindrical inner walls 90 and 91 which form an annular space 92 into which the cylindrical globe 82 can telescope. The base also includes an inner cylindrical wall 93 into which the light: source 84 can telescope. A plurality of dry cell batteries 94 are mounted in the battery compartment which is formed between the cylindrical walls 91 and 93. The base also includes a top wall 95, and a mirror 96 is supported by the top wall.

The light source 84 includes a cylindrical transparent tube 98 and an incandescent light bulb 99 which is mounted in a bulb holder 100. The bulb holder includes a pair of bulb contacts 101 and 102 for supplying electrical power to the bulb.

A pair of metal rods 104 are slidably received in cylindrical bosses 105 in the top wall 95 of the base. A radially outwardly extending cap 106 is mounted on the bottom end of the each of the rods and engages an electrical contact 107 when the rods are in their raised position as illustrated in FIG. 7. One of the contacts 107 is electrically connected to the positive terminals of the batteries 94, and the other contact 107 is electrically connected to the negative terminals of the batteries.

The upper ends of the rods 104 are connected to the cap 83 by a pair of nuts or bushings 109 and 110 which are mounted on the rods. The upper bushing 109 is electrically connected to a conductive plate 111 which is mounted within the cap 83. The plate 111 is electrically connected to the bulb contact 101 by an electrical contact 112.

The other metal rod is electrically connected to a rotatable switch 113 which includes an electrical contact 114 which, when the switch is on, is connected to the bulb contact 102.

When the cap, globe, and rods are in their raised positions illustrated in FIG. 7, the lantern can be turned on by rotating the switch 113 to its on position. Electrical power is thereby conducted from the batteries through the rods 104 to the bulb 99.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A collapsible lantern comprising:

a base having a bottom and a top, a power source in the base, a light source telescopingly mounted relative to the base, means for electrically connecting the power source and the light source, a cap above the light source, the cap and the light source being movable between a raised position in which the cap is spaced above the top of the base and the light source is positioned between the base and the cap and a lowered position in which the cap is adjacent the top of the base and the light source is telescoped inside the base, and in which the power source comprises a plurality of batteries in the base, the batteries being spaced apart in a center of the base to provide an opening into which the light source is telescoped in the lowered position.

2. The lantern of claim 1 in which said electrical connecting means includes a pair of metal rods telescopingly mounted in the base, each of the rods having a top end attached to the cap, and means connecting the rods to the battery and to the light source for providing power from the batteries to the light source.

3. The lantern of claim 2 including a transparent globe surrounding the rods and the light source and telescopingly mounted in the base.

4. The lantern of claim 3 in which the light source is a fluorescent tube.

5. The lantern of claim 2 in which the cap includes a bottom wall and a top wall, the metal rods extending through openings in the bottom wall, and retaining means releasably secured to the top end of each rod for retaining the bottom wall on the rods.

6. The lantern of claim 1 in which said electrical connecting means includes a pair of metal rods telescopingly mounted in the base, each of the rods having a top end attached to the cap, and means connecting the rods to the battery and to the light source for providing power from the batteries to the light source.

7. The lantern of claim 6 in which the cap includes a bottom wall and a top wall, the metal rods extending through openings in the bottom wall, and retaining means releasably secured to the top end of each rod for retaining the bottom wall on the rods.

8. The lantern of claim 1 including a transparent globe surrounding the light source and telescopingly mounted in the base.

9. The lantern of claim 8 in which the globe is generally cylindrical, and means on the globe and the base for preventing relative rotation between the globe and the base.

10. The lantern of claim 8 in which the globe is generally cylindrical and includes an upper end which engages the cap and a lower end which is telescopingly mounted in the base, the globe being movable between raised and lowered positions, and means on the lower end of the globe and the base for releasably maintaining the globe in the raised position.

11. The lantern of claim 10 in which the maintaining means includes a radially extending projection on the lower end of the globe and a recess on the base.

12. The lantern of claim 11 in which the maintaining means further includes a resilient gasket between the globe and the base for resiliently biasing the projection into the recess.

13. The lantern of claim 8 including means on the upper end of the globe for releasably maintaining the globe in the lowered position.

14. The lantern of claim 13 in which the maintaining means on the upper end of the globe includes a radially extending projection which is positioned in said recess in the base when the globe is in the lowered position.

15. A collapsible lantern comprising:

a base having a bottom and a top, a power source in the base, a light source telescopingly mounted relative to the base, means for electrically connecting the power source and the light source, and a cap above the light source, the cap and the light source being movable between a raised position in which the cap is spaced above the top of the base and the light source is positioned between the base and the cap and a lowered position in which the cap is adjacent the top of the base and the light source is telescoped inside the base, said electrical connecting means including a pair of metal rods telescopingly mounted in the base, each of the rods having a top end attached to the cap, and means connecting the rods to the battery and to the light source for providing power from the batteries to the light source.

16. The lantern of claim 15 in which the cap includes a bottom wall and a top wall, the metal rods extending through openings in the bottom wall, and retaining means releasably secured to the top end of each rod for retaining the bottom wall on the rods.

* * * * *